US006138924A

United States Patent [19]

Hunter et al.

[11] Patent Number: 6,138,924

[45] Date of Patent: Oct. 31, 2000

[54] POP-UP ROTOR TYPE SPRINKLER WITH SUBTERRANEAN OUTER CASE AND PROTECTIVE COVER PLATE

[75] Inventors: Richard E. Hunter, La Jolla; Revis R. Hunter, Oceanside, both of Calif.

[73] Assignee: Hunter Industries, Inc., San Marcos, Calif.

[21] Appl. No.: 09/497,430

[22] Filed: Feb. 4, 2000

Related U.S. Application Data

[63] Continuation of application No. 09/256,971, Feb. 24, 1999, abandoned.

[51] Int. Cl.[7] ..... B05B 15/10

[52] U.S. Cl. ..... 239/204; 239/205; 239/230; 239/240; 239/289

[58] Field of Search ..... 239/204, 203, 239/201, 205, 206, 225.1, 230, 231, 237, 240, 242, 289

[56] References Cited

U.S. PATENT DOCUMENTS

| | | | |
|---|---|---|---|
| 1,393,992 | 7/1983 | Strunk et al. | 239/200 |
| 1,837,322 | 12/1931 | Hamilton . | |
| 1,893,210 | 1/1933 | Rider | 239/201 |
| 2,909,326 | 10/1959 | Hruby Jr. | 239/206 |
| 2,989,246 | 6/1961 | Sloane | 239/204 |
| 3,018,057 | 1/1962 | Anderson | 239/201 |
| 3,107,056 | 10/1963 | Hunter | 239/206 |
| 3,265,310 | 8/1966 | Cohen | 239/201 |
| 3,662,956 | 5/1972 | Hedman | 239/201 |
| 3,715,077 | 2/1973 | Granier | 239/200 |
| 3,724,757 | 4/1973 | Hunter | 239/205 |
| 3,762,642 | 10/1973 | Di Santo | 239/201 |
| 3,904,120 | 9/1975 | Sbicca | 239/201 |
| 3,929,288 | 12/1975 | Brusadin et al. | 239/201 |
| 3,930,618 | 1/1976 | Lockwood | 3/4 |
| 4,182,494 | 1/1980 | Wichman et al. | 3/14 |
| 4,253,608 | 3/1981 | Hunter | 3/16 |
| 4,274,592 | 6/1981 | Westhusin | 239/200 |
| 4,316,579 | 2/1982 | Ray et al. | 15/10 |
| 4,417,691 | 11/1993 | Lockwood | 3/4 |
| 4,432,495 | 2/1984 | Bruninga | 239/204 |
| 4,562,962 | 1/1986 | Hartman | 239/200 |
| 4,568,024 | 2/1986 | Hunter | 3/16 |
| 4,624,412 | 11/1986 | Hunter | 15/10 |
| 4,625,914 | 12/1986 | Sexton et al. | 3/16 |
| 4,681,259 | 7/1987 | Troup et al. | 3/4 |
| 4,718,605 | 1/1988 | Hunter | 3/16 |
| 4,753,391 | 6/1988 | Rogers | 239/203 |
| 4,781,327 | 11/1988 | Lawson et al. | 239/206 |
| 4,787,558 | 11/1988 | Sexton et al. | 239/205 |
| 4,850,532 | 7/1989 | Mackanos | 17/0 |
| 4,971,250 | 11/1990 | Hunter | 239/206 |
| 5,039,011 | 1/1991 | Parker | 239/200 |
| 5,137,307 | 8/1992 | Kinsey | 285/156 |
| 5,213,262 | 5/1993 | Violette | 239/203 |

(List continued on next page.)

OTHER PUBLICATIONS

2045A Maxi–Paw198 Full–or Part–Circle Impact Rotor Pop–Up Sprinklers. RAIN BIRD 1999–2000 Catalog.

*Primary Examiner*—Andres Kashnikow
*Assistant Examiner*—Dinh Q. Nguyen
*Attorney, Agent, or Firm*—Michael H. Jester

[57] ABSTRACT

A sprinkler unit of the type that includes an impact drive sprinkler vertically reciprocable inside a subterranean can or case is modified to incorporate a modern pop-up rotor-type sprinkler. The rotor-type sprinkler has a lower retraction spring retainer half-way up its outer riser and a shortened retraction spring. A cylindrical adaptor sleeve surrounds the riser and has its upper end screwed into the upper end cap of the rotor-type sprinkler. The impact drive sprinkler and its attached riser assembly are unscrewed from the subterranean mounting case. Thereafter, a lower male threaded end of the adaptor sleeve is screwed into a female threaded segment at the junction of the lower and upper sections of the cylindrical mounting case. A ring-shaped protective cover plate with a pair of spring retention arms is rotatably mounted to the top end of the rotor-type sprinkler to fill the gap between the sprinkler and the upper curved lip of the cylindrical mounting case.

25 Claims, 3 Drawing Sheets

U.S. PATENT DOCUMENTS

| | | | |
|---|---|---|---|
| 5,222,669 | 6/1993 | Lawson | 15/6 |
| 5,265,803 | 11/1993 | Thayer | 239/71 |
| 5,372,306 | 12/1994 | Yianilos | 239/201 |
| 5,375,768 | 12/1994 | Clark | 3/4 |
| 5,772,118 | 6/1998 | Fabiano | 239/276 |
| 5,817,156 | 2/1999 | Lawson | 25/6 |
| 5,871,156 | 2/1999 | Lawson | 25/6 |
| 5,899,386 | 5/1999 | Miyasato et al. | 3/0 |
| 5,992,760 | 11/1999 | Kearby et al. | 239/205 |
| 5,996,905 | 12/1999 | Bedford | 239/204 |
| 6,000,632 | 12/1999 | Wallace | 239/205 |
| 6,050,502 | 11/1999 | Clark | 239/240 |

POP-UP ROTOR TYPE SPRINKLER WITH SUBTERRANEAN OUTER CASE AND PROTECTIVE COVER PLATE

This application is a continuation of application Ser. No. 09/256,971 filed Feb. 24, 1999, now abandoned.

BACKGROUND OF THE INVENTION

The present invention relates to irrigation sprinklers, and more particularly, to an irrigation sprinkler which combines a pop-up rotor-type sprinkler into a subterranean outer cylindrical mounting case having a protective cover plate.

Sprinklers that eject a stream of water that is slowly rotated over an adjustable arc are widely used to irrigate lawns, golf courses and playing fields. One form of such sprinkler that has been used for decades is the impact drive sprinkler. It includes a sprinkler body with an inclined nozzle for ejecting a stream of water. An oscillating impact arm has a reaction member which is repeatedly deflected laterally away from the stream of water and then biased back against the stream by a spring. The angular momentum imparted by the impact arm rotates the sprinkler body in increments. To effect part circle operation, the impact drive sprinkler includes a reversing mechanism including a trip arm pivotally mounted on the sprinkler body by a pivot pin and coupled by an over-center spring to a reversing arm also pivotally mounted to the sprinkler body by another pivot pin. The trip arm and the reversing arm are coupled together by the over-center spring in such a manner that the trip arm and the reversing arm are each moveable between two stable positions. The spring acts to hold the trip arm and the reversing arm in one or the other of their two stable positions. Movement of the trip arm and the reversing arm between their stable positions is effected by means of a trip extension which depends downwardly from the trip arm to engage adjustable trip stops disposed about the upper portion of a cylindrical support sleeve.

One version of an impact drive sprinkler which has been widely commercialized is disclosed in U.S. Pat. No. 4,182,494 granted Jan. 8, 1980 to Wichman et al. The impact drive sprinkler is mounted on a riser assembly and upon the application of water pressure rises up out of an upwardly opening subterranean cylindrical mounting case whose upper edge terminates at ground level. A disk-shaped protective cover plate is rotatably mounted to the top of the impact drive sprinkler. When the riser and the impact drive sprinkler are retracted into the cylindrical mounting case the rim of the cover plate fits within a lip formed in the upper end of the cylindrical mounting case. A supply line is coupled to through the bottom or side wall of the cylindrical mounting case to pressurize the riser with water.

Impact drive sprinklers have the advantage of significant tolerance to dirt and other debris in the water supply. However, they suffer from a number of drawbacks. They are relatively noisy owing to the "tat, tat, tat" and return "flutter" sounds that are generated by the reaction member intercepting the high pressure water stream. Their plastic parts tend to break or wear out because of the repeated impacts required to provide the driving force. In addition, the arc adjustment springs often slip so the originally set arc or sector is not maintained. For these reasons, impact drive sprinklers have been largely supplanted in new installations by pop-up rotor-type sprinklers that have turbines that drive nozzles through precisely defined arcs. These pop-up rotor-type sprinklers are relatively quiet and can uniformly distribute a precise amount of water over a carefully controlled arc. Rotor-type sprinklers are much more compact than impact drive sprinklers mounted in subterranean cases and require less maintenance.

Many of the impact drive sprinklers mounted in a subterranean cylindrical mounting case, such as those illustrated in U.S. Pat. No. 4,182,494, have been installed and operating for many years and are reaching the ends of their useful lives. The custom has been to replace the worn out impact drive sprinkler with a new impact drive sprinkler in the same subterranean cylindrical mounting case. Landscape maintenance personnel would prefer the advantages of replacing the impact drive sprinkler with a modern pop-up rotor-type sprinkler in order to gain all of its performance and reliability attributes. However, the substantial effort required to dig out the subterranean cylindrical mounting case that houses the impact driver sprinkler and install the required fittings and fixed riser segments to connect and mount a rotor-type sprinkler at grade level has not made this an attractive alternative.

It would therefore be desirable to provide a way to retrofit the millions of units of subterranean impact drive sprinklers "in a can" with modern pop-up rotor type sprinklers. However, a pop-up rotor-type sprinkler is adapted to couple directly to a male fitting on a supply line and is not adapted to couple to the subterranean cylindrical mounting case shown in U.S. Pat. No. 4,182,494. Furthermore, a pop-up rotor-type sprinkler would permanently extend far above grade level if a direct coupling between the lower end of the rotor-type sprinkler and the cylindrical mounting case could be made. This would be entirely unacceptable as the sprinkler could then be tripped over and would be an obstacle to play. In addition, there would be a large uncovered gap between the pop-up rotor-type sprinkler and the side wall of the subterranean cylindrical mounting case since pop-up rotor-type sprinklers do not have any protective disk-shaped cover plate.

SUMMARY OF THE INVENTION

It is therefore the primary object of the present invention to provide a way to retrofit a pop-up rotor-type sprinkler in place of an impact drive sprinkler normally extensible within a subterranean cylindrical mounting case.

According to the present invention a sprinkler unit includes an upwardly opening generally cylindrical vertically extending mounting case adapted for subterranean location. The case has a lower smaller diameter section forming a pressure vessel with an inlet and an upper larger diameter section forming a sprinkler housing. The case further includes a female threaded segment at a junction of the upper and lower sections. A pop-up rotor-type sprinkler is mounted inside the housing formed by the upper section of the cylindrical mounting case and extends partially into the pressure chamber formed by the lower section of the cylindrical mounting case. The rotor-type sprinkler includes an upper ring-shaped end cap, and an upper riser retraction spring retainer below the upper end cap. The rotor-type sprinkler further includes a cylindrical riser that is vertically extensible through a central opening in the upper end cap. A lower riser retraction spring retainer is fixed to the riser. A riser retraction spring surrounds the riser between the upper and lower retainers. The sprinkler unit further includes a generally cylindrical vertically extending adaptor sleeve surrounding the riser and coupled at an upper end thereof to the end cap. The adaptor sleeve has a male threaded lower end that is screwed into the female threaded segment of the cylindrical mounting case at a junction of the upper and lower sections. The sprinkler unit may also include a generally horizontally extending ring-shaped protective cover plate rotatably mounted to the upper end cap of the rotor-type sprinkler. The cover plate extends generally horizontally across a gap between the upper end cap of the rotor-type sprinkler and an upper lip of the cylindrical mounting case.

DESCRIPTION OF THE PREFERRED EMBODIMENTS

Figure 1:
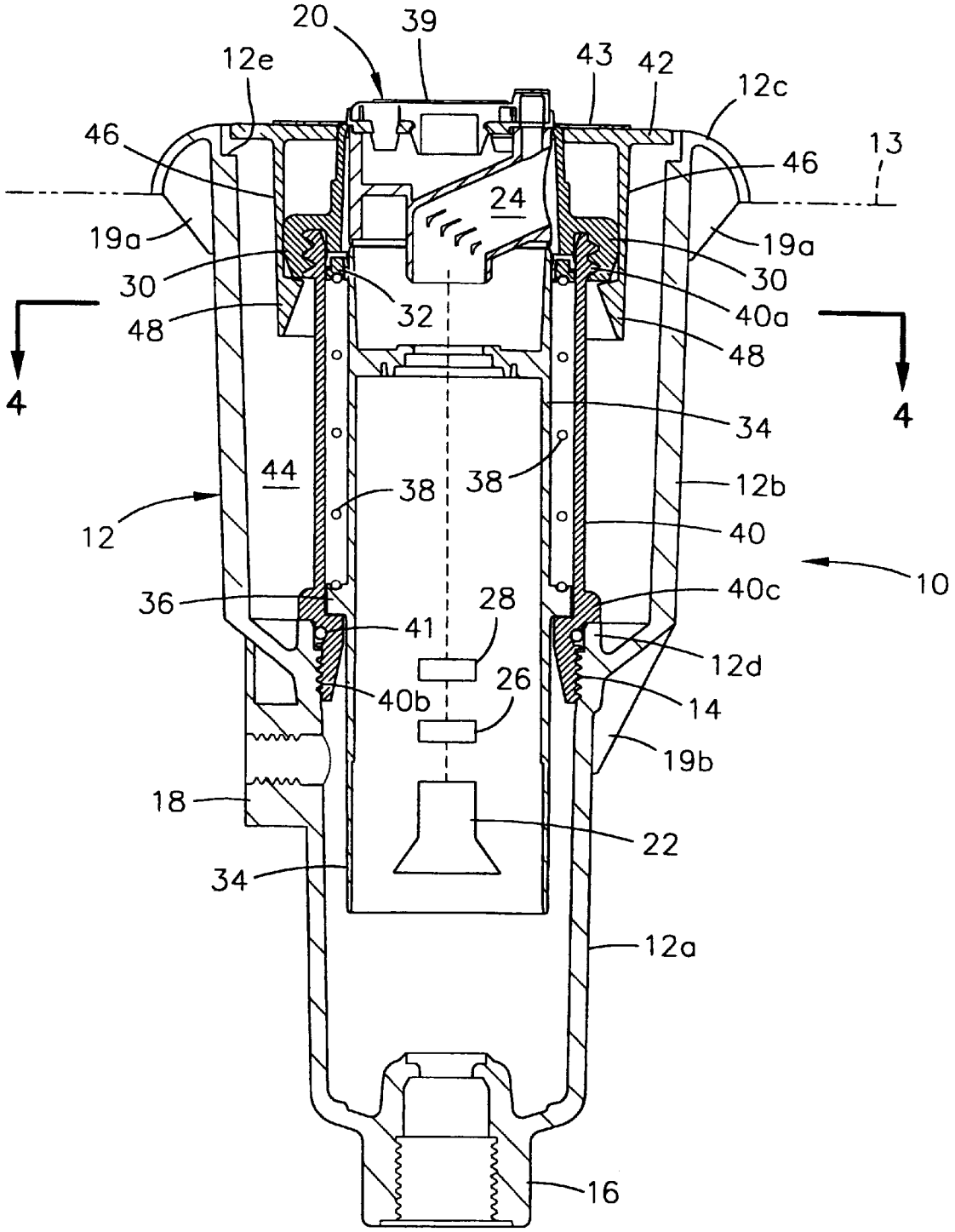
FIG. 1 is a reduced vertical sectional view of a sprinkler unit representing a preferred embodiment of the present invention. The sprinkler unit is shown in its OFF condition in this figure with its riser fully retracted.
Figure 2:
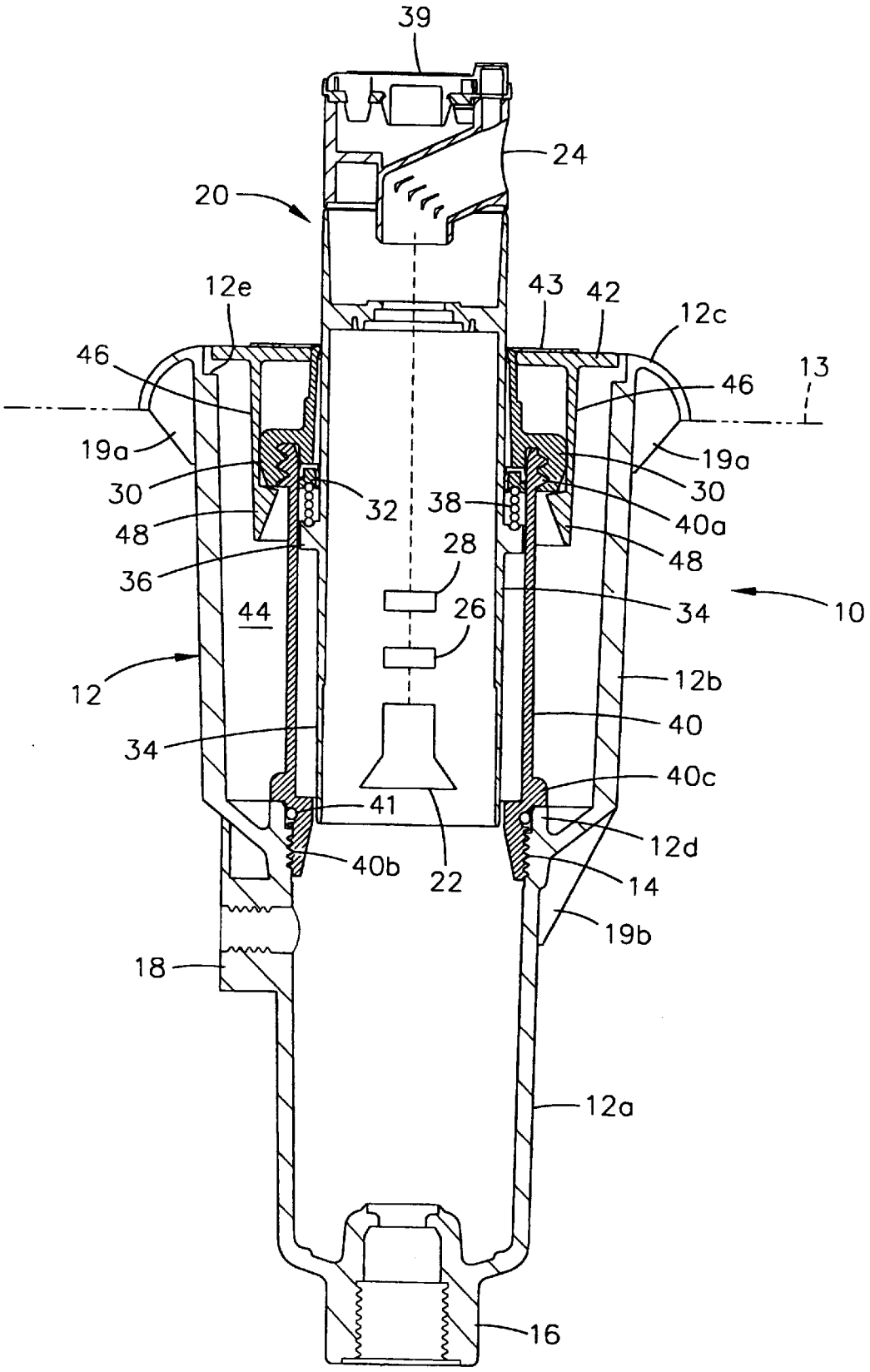
FIG. 2 is a view similar to FIG. 1 showing the sprinkler unit in its ON condition in which its riser is fully extended.

Referring to FIGS. 1 and 2, a sprinkler unit 10 includes an upwardly opening, generally cylindrical mounting case 12. The mounting case 12 is adapted to be buried in a subterranean location in a substantially vertical orientation. The case 12 has a lower smaller diameter section 12*a* forming a pressure vessel and an upper larger diameter section 12*b* forming a sprinkler housing. The upper section 12*b* has a curved upper lip 12*c* whose terminal lower edge is normally positioned at the level of the grade 13, represented by the top of the soil having the turf to be watered. The case 12 has a female threaded segment 14 at a junction of the lower section 12*a* and the upper section 12*b*.

In a commercial version of the impact drive sprinkler in a can (not illustrated), the base of the impact sprinkler (not shown) screws into the female threaded segment 14. The impact drive sprinkler is thus located within the housing formed by the upper section 12*b* of the case 12 when the impact drive sprinkler is retracted. A hexagonal-cross section riser assembly (not shown) operatively coupled to the impact drive sprinkler extends vertically within the pressure vessel formed by the lower section 12*a* of the case 12 when the riser assembly is retracted.

The lower section 12*a* (FIGS. 1 and 2) of the cylindrical mounting case 12 is formed with a female threaded inlet 16 that extends vertically through the bottom wall of the case 12 and permits a male threaded pipe segment of standard diameter (not illustrated) from a supply line to be screwed into the same. The lower section 12*a* of the case 12 is also formed with an alternate female threaded inlet 18 that extends horizontally through the side wall of the case 12. A male threaded pipe segment (not illustrated) of smaller diameter may be screwed into the inlet 18 in installations where it is more convenient not to use a vertical pipe segment from a supply line. The installation of vertical supply pipes from a horizontal supply line typically requires deeper excavation. It will be understood that whichever inlet 16 or 18 is not used to pressurize the pressure vessel formed by the lower section 12*a* of the case 12, that unused inlet is sealed with a threaded plug (not illustrated).

The cylindrical mounting case 12 is preferably injection molded of a suitable plastic as a single unitary structure. The mounting case 12 may be molded of black ABS plastic. Calcium may be added to the ABS plastic as a stiffener agent as is well known in the art. For this reason, the lower case section 12*a* and the upper case section 12*b* each have a very slight taper moving in an upward direction. This facilitates removal of the molded case 12 from the mold tooling. The junction between the upper lip 12*c* and the upper section 12*b* of the case 12 is reinforced with a plurality of equally circumferentially spaced, vertically extending triangular ribs 19*a* (FIG. 3) that extend radially on the exterior of the case 12. The junction between the upper section 12*b* and the lower section 12*a* of the case 12 is reinforced by a plurality of equally circumferentially spaced, vertically extending triangular ribs 19*b* (FIGS. 1 and 2) that extend radially on the exterior of the case 12 except at the location of the side inlet 18. Preferably there are twelve ribs 19*a* and ten ribs 19*b*.

By way of example, the cylindrical mounting case 12 may have an overall height of nine and three-tenths of an inch, and the outer diameter of the lip 12*c* may be five inches. The lower section 12*a* and the upper section 12*b* are approximately the same height, i.e. about four inches. The inside diameter of the upper end of the upper mounting case section 12*b* is preferably about three and three-quarters inches. The inside diameter of the upper end of the lower mounting case section 12*a* is preferably about two and one-quarter inches. The bottom inlet 16 may be a three-quarter inch (20/27) FPT inlet. The side inlet 18 may be a one-half inch (15/21) FPT inlet.

Figure 4:
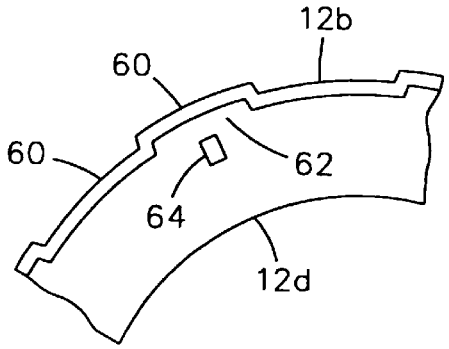
FIG. 4 is a fragmentary horizontal sectional view of a portion of the upper section of the cylindrical mounting case of the sprinkler unit of FIGS. 1–3 taken along line 4—4 of FIG. 1 showing its fluted construction.

The upper section 12*b* is preferably formed with a plurality of vertically extending, circumferentially spaced flutes 60 (FIG. 4) to impart additional strength and stability. The flutes 60 preferably consist of twelve curved but otherwise generally rectangular sections, alternately spaced radially inward and radially outward about one-sixteenth of an inch. The six inwardly opening chambers 62 formed by the flutes 60 are provided with apertures 64 in the bottom walls thereof to facilitate drainage of water from the upper section 12*b* of the mounting case 12. The ribs 19*a* and 19*b* on the outside of the mounting case sections 12*b* and 12*a*, respectively, are aligned with corresponding vertical side walls of the flutes 60 (FIG. 4).

Referring again to FIGS. 1–2, a pop-up rotor-type sprinkler 20 is mounted inside the cylindrical mounting case 12. Except as explained hereafter, the pop-up rotor-type sprinkler 20 is more or less of conventional design and includes a turbine shown diagrammatically at 22 that drives a rotating inclined nozzle 24 through a pre-adjusted arc via a reduction gear drive shown diagrammatically at 26 and an arc adjustment/reversing mechanism shown diagrammatically at 28. The vertical drive axis for the nozzle 24 and its mechanical coupling to the turbine 22, reduction gear drive 26 and arc adjustment/reversing mechanism 28 is shown in FIGS. 1 and 2 as vertical dashed line connecting these components. The rotor-type sprinkler 20 has an upper stepped and ring-shaped end cap 30 and an upper riser retraction spring retainer 32 below the upper end cap 30. A cylindrical riser 34 of the rotor-type sprinkler 20 is vertically extensible, via applied water pressure, through a central opening (not labeled) in the upper end cap 30. A screen (not illustrated) mounted inside the riser 34 at its lower end filters dirt and other debris from the water before it reaches the turbine 22.

Unlike conventional rotor-type sprinklers, the rotor-type sprinkler 20 has a lower riser retraction spring retainer 36 that is positioned roughly intermediate the length of the riser 34 instead of being located at the bottom of the riser 34. A steel helical coil riser retraction spring 38, which is shorter than a riser retraction spring of a conventional pop-up rotor-type sprinkler, surrounds the riser 34 and is held in place between the upper retainer 32 and the lower retainer 36. The spring 38 is shown in its extended configuration in FIG. 1. The spring 38 is shown in its compacted configuration in FIG. 2 after the water has been turned ON to the sprinkler unit 10 and the riser 34 has extended upwardly.

As shown in FIG. 1, when the water pressure to the sprinkler unit 10 is turned OFF, the riser 34 is retracted under the force of the energy stored in the spring 38. Approximately one-third of the length of the riser 34 is then retracted into the pressure vessel formed by the lower section 12*a* of the mounting case 12. The rotor-type sprinkler 20 has an upper end 39 including a elastomeric cap with a cross-slit opening 39*a* (FIG. 3) through which the thin metal shaft of an arc adjustment tool (not illustrated) may be manually inserted. When the riser 34 is fully retracted the cap 39 extends slightly above the uppermost portion of the lip 12*c* of the case 12. This is achieved by appropriately dimensioning the adapter sleeve 40, and by appropriately positioning the lower retainer 36 intermediate the ends of the riser 34.

Examples of suitable pop-up rotor-type sprinklers that can be readily modified to serve at the sprinkler 20 (FIG. 1) are disclosed in U.S. Pat. No. 3,107,056 of Edwin J. Hunter; U.S. Pat. No. 3,724,757 of Edwin J. Hunter; U.S. Pat. No. 4,568,024 of Edwin J. Hunter; U.S. Pat. No. 4,624,412 of Edwin J. Hunter; U.S. Pat. No. 4,718,605 of Edwin J. Hunter; and U.S. Pat. No. 5,375,768 of Michael L. Clark. The entire disclosures of each of these issued U.S. patents are specifically incorporated herein by reference.

The preferred pop-up rotor-type sprinkler 20 for use in the retrofitted sprinkler unit 10 of the present invention is the HUNTER PGP (Trademark) rotor-type sprinkler which has been successfully commercialized for many years by HUNTER INDUSTRIES INC. of San Marcos, Calif., the assignee of the present application. The HUNTER PGP sprinkler has a large dirty water screen, a proven long-life gear drive, and an arc adjustment mechanism which permits adjustable arcs to be set from forty degrees to three-hundred and sixty degrees. It also has durable rubber top cap which is integral to the upper end of its riser. The HUNTER PGP sprinkler also accepts twelve standard nozzles and seven low-angle nozzles that provide a wide variety of precipitation rates. The HUNTER PGP sprinkler can provide discharge rates between 0.5 and 14.4 gallons per minute over a radius of twenty-two to fifty-two feet and operates optimally at water pressures between about thirty PSI to about seventy PSI. It can provide precipitation rates of approximately four-tenths of an inch per hour at fifty PSI, with a standard nozzle trajectory of approximately twenty-five degrees and a low angle nozzle trajectory of approximately thirteen degrees. The standard amount of pop-up for the riser of the HUNTER PGP sprinkler is approximately four inches. The HUNTER PGP sprinkler is highly durable and very quiet. It can uniformly distribute water at a precise rate of precipitation over a precisely determined arc for many years.

Where the sprinkler 20 of the sprinkler unit 10 (FIGS. 1–3) is a modified HUNTER PGP pop-up rotor-type sprinkler, the riser 34 only extends upwardly out of the sleeve 40 about two inches. This compares to an extension of approximately four inches in a normal HUNTER PGP which does not work with the re-positioned lower retainer 36 and shorter coil spring 38 of the present invention. This smaller riser stroke allows the modified HUNTER PGP to be accommodated in the upper and lower sections of the cylindrical mounting case of the commercial version of the impact sprinkler in a can disclosed in U.S. Pat. No. 4,182,494.

Referring still to FIGS. 1 and 2, a generally cylindrical, vertically extending, injection molded plastic adaptor sleeve 40 surrounds the riser 34. It is also preferably injection molded of a suitable plastic which may be the same, or different than that used in molding the cylindrical mounting case 12. One suitable plastic for the adaptor sleeve is black ABS plastic which is fully recyclable. A male threaded upper end 40*a* of the sleeve 40 is screwed into female threads on the underside of the end cap 30. A male threaded segment of the lower end 40*b* of the sleeve 40 is screwed into the female threaded segment 14 of the cylindrical mounting case 12 at the junction of the lower section 12*a* and the upper section 12*b*. An elastomeric O-ring 41 surrounds the lower end 40*b* of the adaptor sleeve 40 to provide a water-tight seal. The O-ring 41 is seated in an annular groove just above the male threaded segment of the lower end 40*b*. The adaptor sleeve 40 is formed with a downwardly facing shoulder 40*c* that mates with a corresponding upwardly facing shoulder 12*d* of the case 12 to provide a stop that limits the extent to which the male threaded segment of the lower end 40*b* of the sleeve 40 can be screwed into the female threaded segment 14 of the case 12. This limits the amount of deformation of the O-ring 41 and prevents damage to the same. The lower retainer 36 also serves as a sort of sliding bushing which engages the inside annular surface of the adaptor sleeve 40 to center the riser 34 as it extends and retracts.

A ring-shaped plastic protective cover plate 42 (FIG. 3) is rotatably mounted to the upper end cap 30 of the rotor-type sprinkler 20. The cover plate 42 extends generally horizontally across a gap between the upper end cap 30 of the rotor-type sprinkler 20 and the upper lip 12*c* of the cylindrical mounting case 12. This prevents dirt and other debris from falling into the a relatively large annular space 44 (FIG. 1) between the exterior surface of the adaptor sleeve 40 and inner surface of the upper section 12*b* of the cylindrical mounting case 12. The cover plate 42 has a large central opening 42*a* (FIG. 3) that is sized to permit the riser 34 to reciprocate upwardly and downwardly therethrough. Raised lettering 43 (FIGS. 1 and 2) molded into the cover plate 42 can indicate the trademark and model number. This raised lettering is not shown in FIG. 3.

A diametrically spaced pair of plastic retainer arms 46 (FIGS. 1 and 2) extend downwardly from the underside of the ring-shaped cover plate 42. The location of the retainer arms 46 is also shown in phantom lines in FIG. 3. The hook-shaped lower ends 48 (FIGS. 1 and 2) of the retainer arms 46 engage the underside of the end cap 30 to loosely hold the cover plate 42 to the upper end of the rotor-type sprinkler 20 in a manner that still allows the cover plate 42 to rotate relative to the body of the sprinkler 20. This prevents the torque that would otherwise be generated by a lawn mower wheel or a person's foot striking the cover plate 42 from unscrewing the adaptor sleeve 40. The retainer arms 46 are springy and resilient and deflect outwardly when the retainer arms 46 are pushed down over the end cap 30 and then snap back into place. The underside of the outer peripheral edge of the cover plate 42 is supported by an upwardly facing inner shoulder 12*e* of the upper section 12*b* of the cylindrical mounting case 12. A pair of one-quarter inch long vertical posts 50 (FIG. 3) extend from the underside of the cover plate 42 and loosely engage the exterior of the upper smaller diameter portion of the end cap 30 in order to assist in alignment of the cover plate 42 relative to the rotor-type sprinkler 20. Preferably the cover plate 42, retainer arms 46, hook-shaped ends 48 and posts 50 are injection molded as a single unitary structure made of the same ABS plastic as the cylindrical mounting case 12.

Figure 3:
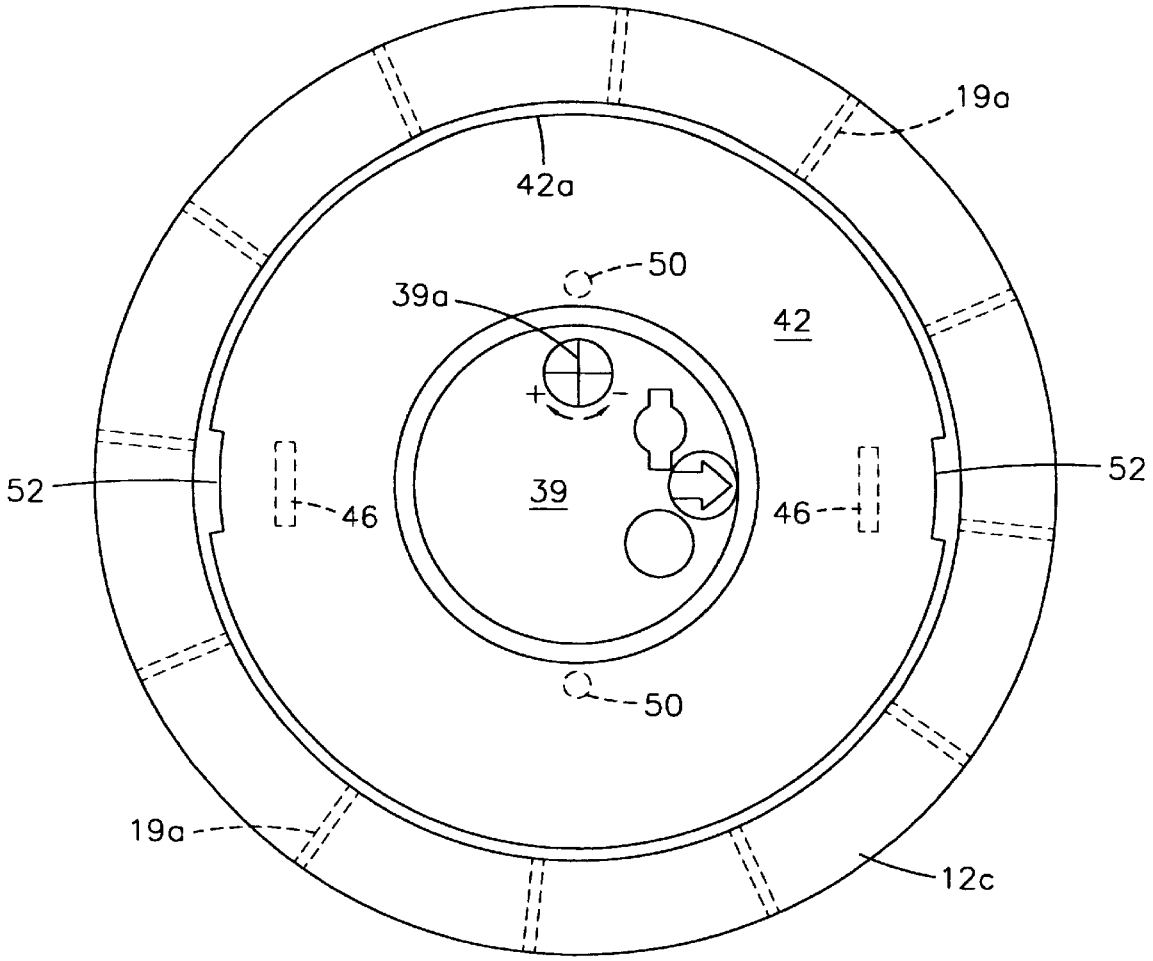
FIG. 3 is a full scale top plan view of the sprinkler unit shown in FIGS. 1 and 2.

As shown in FIG. 1, the upper end 39 of the sprinkler 20 extends slightly above the cover plate 42 when the riser 34 is in its fully retracted position. The peripheral edge of the cover plate 42 is formed with a pair of diametrically spaced slots 52 (FIG. 3). The top of flat head screw driver or other suitable tool can be inserted into either of the slots 52 to facilitate removal of the cover plate utilizing a prying action. This allows a person to manually grasp the rotor-type sprinkler 20 and unscrew the adaptor sleeve 40 from the cylindrical mounting case 20. The rotor-type sprinkler 20 can then be repaired or replaced.

Those skilled in the sprinkler art will appreciate that we have also provided a method of rapidly retrofitting a widely used impact drive sprinkler unit. That impact drive sprinkler unit is disclosed in the aforementioned U.S. Pat. No. 4,182,494 and comprises a subterranean upwardly opening cylindrical mounting case having an impact drive sprinkler mounted in an upper section thereof on an extensible riser assembly mounted in a lower section thereof. The impact drive sprinkler unit to be retrofitted further comprises a protective disk-shaped cover plate mounted on top of the impact drive sprinkler. In accordance with our method the impact drive sprinkler, the attached riser assembly and the protective cover plate are removed from the subterranean case without digging around the case. The pop-up rotor-type sprinkler 20 is inserted inside of the cylindrical adaptor sleeve 40 and coupled at its upper end 40*a* of the sleeve 40 to an upper ring-shaped upper end cap 30 of the sprinkler 20. The sprinkler 20 includes a riser 34 that encloses a nozzle 24 at an upper end thereof, a lower riser retraction spring retainer 36 on the riser 34, an upper riser retraction spring retainer 32 beneath the end cap 30, and a riser retraction spring 38 that surrounds the riser 34 and has its upper and lower terminal ends contained by the retainers 32 and 36. The male threaded segment 40*b* of the lower end of the adaptor sleeve 40 is screwed into the female threaded segment 14 connecting the upper and lower sections 12*b* and 12*a* of the mounting case 12. A lower portion of the riser 34 extends into the lower section 12*a* of the mounting case 12 when a source of pressurized water connected to the lower section 12*a* is turned OFF and an upper portion of the riser 34 containing the nozzle 24 extends above the upper section 12*b* of the mounting case 12 when the source of pressurized water is turned ON. An additional optional step of our method entails the installation of a ring-shaped protective cover plate 42 so that it extends horizontally between the rotor-type sprinkler 20 and an upper lip 12*c* of the mounting case 12. Finally, the arc adjustment mechanism 28 of the rotor-type sprinkler 20 is manually adjusted by inserting the thin shaft of a tool in the cross-slit opening 39*a* and twisting the tool as necessary to set the desired arc limits. A stream of water ejected from the nozzle 24 will then be sprayed quietly and uniformly over a predetermined arc.

While we have describe a preferred embodiment of our sprinkler unit in detail, and a method of retrofitting and modernizing an impact sprinkler in a can, it will be apparent to those skilled in the art that our invention can be modified in both arrangement and detail. For example, the cover plate 42 is not an essential element of our invention, as the sprinkler unit 10 will still operate satisfactorily even if the annular space 44 were completely filled with water and/or dirt. The prior art sprinkler unit of the aforementioned U.S. Pat. No. 4,182,494 will fail if the mounting case fills with mud, as frequently occurs when the unit is mounted on or near a slope. This prevents the impact sprinkler from operating. Therefore, the protection afforded our invention should only be limited in accordance with the scope of the following claims.

We claim:

1. A sprinkler unit, comprising:

an upwardly opening generally cylindrical vertically extending mounting case adapted for subterranean location, the case having a lower smaller diameter section forming a pressure vessel with an inlet, an upper larger diameter section forming a sprinkler housing, and a female threaded segment at a junction of the upper and lower sections;

a pop-up rotor-type sprinkler including an upper end cap, an upper riser retraction spring retainer adjacent the end cap, a cylindrical riser vertically extensible through a central opening in the upper end cap, a lower riser retraction spring retainer fixed to the riser, and a riser retraction spring surrounding the riser between the upper and lower retainers; and a generally cylindrical vertically extending adaptor sleeve surrounding the riser and coupled at an upper end thereof to the end cap and having a lower end with a male threaded segment screwed into the female threaded segment of the cylindrical mounting case at a junction of the upper and lower sections.

2. The sprinkler unit of claim 1 and further comprising a generally horizontally extending protective cover plate rotatably mounted to the upper end cap of the rotor-type sprinkler and extending generally horizontally across a gap between the upper end cap of the rotor-type sprinkler and an upper lip of the cylindrical mounting case normally positioned at the level of a grade.

3. The sprinkler unit of claim 2 wherein the cover plate includes a pair of resilient arms that terminate in hook ends for releasably engaging an underside of the upper end cap of the rotor-type sprinkler.

4. The sprinkler unit of claim 1 wherein the mounting case includes a plurality of circumferentially spaced reinforcing ribs that connect between an upper lip of the mounting case and the upper section of the mounting case.

5. The sprinkler unit of claim 1 and further comprising an O-ring surrounding the lower end of the adaptor sleeve above the male threaded segment of the lower end.

6. The sprinkler unit of claim 5 wherein the adaptor sleeve is formed with a downwardly facing shoulder that mates with a corresponding upwardly facing shoulder of the mounting case to provide a stop that limits the extent to which the male threaded segment of the lower end of the adaptor sleeve can be screwed into the female threaded segment of the mounting case and limits the amount of deformation of the O-ring.

7. The sprinkler unit of claim 1 wherein the mounting case includes a plurality of circumferentially spaced reinforcing ribs that connect between the lower section of the mounting case and the upper section of the mounting case.

8. The sprinkler unit of claim 1 wherein the mounting case includes a first vertical female threaded inlet formed in a bottom wall of the lower section of the mounting case and communicating with the pressure vessel and a second horizontally extending female threaded inlet formed in a side wall of the lower section of the mounting case and communicating with the pressure vessel.

9. The sprinkler unit of claim 1 wherein the rotor-type sprinkler includes an elastomeric cap with an opening for receiving an arc adjustment tool.

10. The sprinkler unit of claim 1 wherein the upper section of the mounting case is fluted.

11. A method of retrofitting a subterranean sprinkler unit that includes an upwardly opening cylindrical mounting case having an impact drive sprinkler mounted in an upper section thereof on an extensible riser assembly mounted in a lower section thereof, and including a protective disk-shaped cover plate mounted on top of the impact drive sprinkler, comprising the steps of:

removing the impact drive sprinkler, the riser assembly and the protective cover plate from the subterranean case without digging around the subterranean case;

inserting a pop-up rotor-type sprinkler inside of a cylindrical adaptor sleeve and coupling an upper end of the sleeve to an upper ring-shaped upper end cap of the rotor-type sprinkler, the rotor type sprinkler including a riser that encloses a nozzle at an upper end thereof, a lower riser retraction spring retainer on the riser, an upper riser retraction spring retainer beneath the end cap, and a riser retraction spring surrounding the riser and having its ends contained by the retainers; and screwing a male threaded segment of a lower end of the adaptor sleeve into a female threaded segment connecting the upper and lower sections of the mounting case so that a lower portion of the riser extends into the lower section of the mounting case when a source of pressurized water connected to the lower section is turned OFF and so that an upper portion of the riser containing the nozzle will extend above the upper section when the source of pressurized water is turned ON.

12. The method according to claim 11 and further comprising the step of installing a ring-shaped protective cover plate so that it extends horizontally between the rotor-type sprinkler and an upper lip of the mounting case.

13. The method according to claim 12 wherein the protective cover plate is rotatably connected to the upper end cap of the sprinkler.

14. The method according to claim 11 wherein the lower end of the adaptor sleeve is provided with a shoulder that engages a corresponding shoulder on the mounting case to limit the degree to which the adaptor sleeve can be screwed into the mounting case.

15. The method according to claim 11 and further comprising the step of mounting a O-ring around the lower end of the adapter sleeve to provide a water-tight seal.

16. The method according to claim 11 and further wherein the rotor-type sprinkler includes an arc adjustment mechanism.

17. The method according to claim 11 wherein the lower riser retraction spring retainer is formed approximately midway of a height of the riser.

18. The method according to claim 11 and further comprising the step of adjusting an arc adjustment mechanism of the rotor-type sprinkler so that a stream of water ejected therefrom will be sprayed over a predetermined arc.

19. The method according to claim 12 and further comprising the step of removing the protective cover plate by inserting a tool in a slot formed in a peripheral edge of the cover plate and prying the cover plate out of the upper section of the mounting case.

20. A sprinkler unit, comprising:

an upwardly opening generally cylindrical vertically extending mounting case injection molded out of plastic as a single unitary structure and adapted for subterranean location, the case having a tapered lower smaller diameter section forming a pressure vessel with an inlet, a tapered upper larger diameter fluted section forming a sprinkler housing, an upper lip formed at an upper end of the upper section and normally positioned at the level of a grade, a female threaded segment at a junction of the upper section and the lower section of the mounting case, a plurality of circumferentially spaced first reinforcing ribs that extend radially and vertically between the upper lip and the upper section of the mounting case, a plurality of circumferentially spaced second reinforcing ribs that extend radially and vertically between the lower section of the mounting case and the upper section of the mounting case, a first vertical female threaded inlet formed in a bottom wall of the lower section of the mounting case and communicating with the pressure vessel and a second horizontally extending female threaded inlet formed in a side wall of the lower section of the mounting case and communicating with the pressure vessel;

a pop-up rotor-type sprinkler including a turbine driven rotating nozzle, a ring-shaped upper end cap, an upper riser retraction spring retainer below the upper end cap, a cylindrical riser vertically extensible through a central opening in the upper end cap, a lower riser retraction spring retainer intermediate a length of the riser, and a riser retraction spring surrounding the riser and held between the upper and lower retainers;

a generally cylindrical vertically extending adaptor sleeve surrounding the riser and having a male threaded upper end screwed into a female threaded inwardly facing surface of the end cap, and a lower end with a male threaded segment screwed into the female threaded segment of the cylindrical mounting case at the junction of the upper and lower sections;

an O-ring surrounding the lower end of the adaptor sleeve above the male threaded segment of the lower end of the adaptor sleeve and providing a water-tight seal between the adaptor sleeve and the cylindrical mounting case;

the adaptor sleeve being formed with a downwardly facing shoulder that mates with a corresponding upwardly facing shoulder of the mounting case to provide a stop that limits the extent to which the male threaded segment of the lower end of the adaptor sleeve can be screwed into the female threaded segment of the mounting case and limits the amount of deformation of the O-ring; and a generally horizontally extending protective cover plate rotatably mounted to the upper end cap of the rotor-type sprinkler and extending generally horizontally across a gap between the upper end cap of the rotor-type sprinkler and the lip of the cylindrical mounting case.

21. A method of retrofitting an already installed impact drive sprinkler in a can previously buried in the ground, the method comprising the steps of:

locating an upwardly opening cylindrical mounting case, the case being buried in the ground and having an upper lip positioned at grade level, the case including an impact drive sprinkler mounted in an upper section of the case on an extensible riser assembly that extends into a lower section of the case, the lower section of the case being connected to a water supply pipe, and the upper section of the case having a protective disk-shaped cover plate mounted on top of the impact drive sprinkler;

removing the impact drive sprinkler, the riser assembly and the protective cover plate from the case without removing the case from the ground or disconnecting the water supply pipe from the lower section of the case;

providing a portion of a turbine driven pop-up rotor-type sprinkler, the rotor-type sprinkler having an extensible riser that has a nozzle at an upper end thereof;

installing a riser retraction spring around the riser;

inserting the portion of the pop-up rotor-type sprinkler and the spring inside of the case; and threadably coupling a lower end of the portion of the rotor-type sprinkler to a segment of the case connecting the upper and lower sections of the case so that a lower portion of the riser extends into the lower section of the mounting case when a source of pressurized water connected to the lower section is turned OFF, an upper portion of the riser containing the nozzle extends above the upper section of the case and the nozzle rotates and discharges a stream of water when the source of pressurized water is turned ON, and the riser retraction spring will retract the riser back into the case when the source of pressurized water is turned OFF.

22. The method according to claim 21 and further comprising the step of installing a ring-shaped protective cover plate so that it extends horizontally between the rotor-type sprinkler and the upper lip of the mounting case.

23. The method according to claim 22 and further comprising the step of removing the protective cover plate by prying the cover plate out of the upper section of the mounting case.

24. The method according to claim 21 and further comprising the step of adjusting an arc adjustment mechanism of the pop-up rotor-type sprinkler so that a stream of water ejected from the nozzle will be sprayed over a predetermined arc.

25. The method according to claim 21 wherein the coupling step is performed by installing a cylindrical adaptor sleeve around the riser and the riser retraction spring and screwing a male threaded lower end of the sleeve into a female threaded segment of the mounting case between the upper and lower sections of the mounting case.

* * * * *